US006854919B2

(12) United States Patent
Neumann et al.

(10) Patent No.: US 6,854,919 B2
(45) Date of Patent: Feb. 15, 2005

(54) PUSH-LOCK HANDLE ASSEMBLY

(75) Inventors: Peter M. Neumann, Racine, WI (US); Kenneth H. Kloet, Pleasant Prairie, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 10/178,663

(22) Filed: Jun. 20, 2002

(65) Prior Publication Data

US 2003/0235463 A1 Dec. 25, 2003

(51) Int. Cl.[7] ..... B25G 1/04; B25G 3/12

(52) U.S. Cl. ..... 403/326; 403/109.2; 15/145; 16/422

(58) Field of Search ..... 403/348, 349, 403/274, 279, 280, 282, 292, 321, 322.1, 345, 327, 109.2, 109.3, 326, 325, 329, 315–317, 289; 16/422, 427, 114 R, DIG. 41; 15/143.1, 144.1–144.4, 145

(56) References Cited

U.S. PATENT DOCUMENTS

| | | | | | |
|---|---|---|---|---|---|
| 303,474 | A | | 8/1884 | Webb | |
| 402,132 | A | | 4/1889 | Berry | |
| 1,029,819 | A | | 6/1912 | Nylander | |
| 1,033,187 | A | | 7/1912 | Metzger | |
| 1,420,639 | A | | 6/1922 | Sturgis | |
| 1,932,099 | A | | 10/1933 | Cabana | |
| 2,076,918 | A | | 4/1937 | Robison | |
| 2,601,088 | A | | 6/1952 | Burgess | |
| 2,712,950 | A | * | 7/1955 | Siebert | 15/145 X |
| 2,719,061 | A | | 9/1955 | Beatty | |
| 2,820,655 | A | | 1/1958 | Hileman | |
| 2,982,586 | A | * | 5/1961 | Gliebe | 403/109.3 |
| 3,407,424 | A | * | 10/1968 | Lanzarone et al. | 15/145 |
| 3,423,781 | A | | 1/1969 | Henson | |
| 3,950,014 | A | * | 4/1976 | Doubleday | |
| 3,957,266 | A | | 5/1976 | Rice | |
| 4,068,333 | A | * | 1/1978 | Gutner | 403/329 X |
| 4,518,162 | A | | 5/1985 | Oates | |
| 4,549,779 | A | * | 10/1985 | Gromek et al. | |
| 4,711,595 | A | * | 12/1987 | Magid et al. | 403/329 X |
| 4,762,437 | A | * | 8/1988 | Mitomi | 411/349 X |
| 4,848,956 | A | | 7/1989 | Pettman | |
| 4,911,573 | A | | 3/1990 | Pietro | |
| 5,094,464 | A | | 3/1992 | Musacchia, Sr. | |
| 5,127,762 | A | * | 7/1992 | Havlovitz | |
| 5,516,190 | A | * | 5/1996 | Kain et al. | |
| 5,641,237 | A | * | 6/1997 | Albert et al. | 403/109.2 X |
| 5,943,727 | A | | 8/1999 | Freer | |
| 5,956,786 | A | * | 9/1999 | Huang | 403/329 X |
| 6,088,868 | A | * | 7/2000 | Cerveny | 15/144.3 |
| 6,179,266 | B1 | * | 1/2001 | Hutten | |
| 6,213,672 | B1 | * | 4/2001 | Varga | 403/109.2 |
| 6,292,979 | B1 | * | 9/2001 | Kuo | 16/DIG. 41 X |
| 6,413,004 | B1 | * | 7/2002 | Lin | 403/329 X |
| D481,610 | S | * | 11/2003 | Neumann et al. | |

FOREIGN PATENT DOCUMENTS

| | | |
|---|---|---|
| DE | 333391 | 8/1913 |
| GB | 10945 | of 1912 |
| GB | 16504 | 7/1912 |
| GB | 1429924 | 3/1976 |
| IT | 683025 | 8/1961 |

OTHER PUBLICATIONS

Depictions of Hoover vacuum cleaner attachments, undated admitted prior art.

* cited by examiner

*Primary Examiner*—John R. Cottingham
*Assistant Examiner*—Ryan M Flandro

(57) ABSTRACT

A push-lock handle assembly includes segments that are interconnected by axial movement using snap-in D-shaped tabs and recesses. Slits and grooves allow the tabs to deflect slightly inwardly during insertion. In another form there is a grip section, at least one pole section, and one accessory attachment section. Simple axial movement snap locks the parts together.

10 Claims, 2 Drawing Sheets

PUSH-LOCK HANDLE ASSEMBLY

CROSS-REFERENCE TO RELATED APPLICATIONS

Not applicable.

STATEMENT OF FEDERALLY SPONSORED RESEARCH OR DEVELOPMENT

Not applicable.

BACKGROUND OF THE INVENTION

This invention relates to handles, and in particular to handles for mops, brooms and other items which are formed of multiple interconnectable segments.

Mops, brooms, paint roller handles, dusters, and similar devices, often have long handles so that a person can stand upright while reaching the floor with the device, and such that a person will not need a ladder to apply the device on a ceiling or high along a wall. The length of the handle typically requires such products to be shipped in specially sized packages, and stored and displayed for sale in a manner that takes up a relatively large amount of space.

Also, when a consumer purchases such a highly elongated device, the device may not fit easily into a standard grocery cart, and may be difficult to fit into a trunk of certain compact cars. Consumers may therefore need to hand carry the device to the store checkout, and then to a vehicle. Also, consumers may need to transport the device in the passenger compartment of the car, with the result that needed passenger space is taken up.

Collapsible handles have been devised to minimize or avoid these problems. For example, telescoping handles, with multiple concentric cylindrical sections, have been developed (particularly for use when painting, and often for use in devices such as golf ball retrievers). Alternatively, some handle designs have folded sections which are hinged together. See e.g. U.S. Pat. No. 5,943,727.

Such constructions typically have rather unstable joints that can loosen (and possibly separate), particularly when rotational force is applied to the handle. These constructions also often tend to flex more at the joints when stressed such that the handle feels segmented.

Attempts have been made to overcome these problems. For example, U.S. Pat. No. 4,911,573 discloses the use of a bayonet connection for joining sections of a handle. Each section has male and female ends that mate with the ends of adjacent sections. The male ends have an L-shaped groove and a spring element spaced apart along the circumference of the male end.

The female end defines a cylindrical opening with a transverse protrusion that rides in the L-shaped groove as the male is inserted and twisted into the opening. The protrusion is held tightly in the groove by virtue of the groove having a decreasing depth. The female also has a hole in which the spring element of the male end snaps to lock the adjacent sections together. Although the disclosed structure provides a rigid connection, it is rather complex to manufacture in that it requires the spring element.

Similarly, the ends of vacuum cleaner extension wands are often provided with interlockable connectors. Typically the wand segments are telescopically slid into each other, with a spring loaded spherical tab on one male portion of a wand snapping outward into a radial hole in a female segment to temporarily connect the parts together. A lower end of the lowest wand is linked to a floor treatment device (e.g. a brush), and the upper end of the highest wand is linked to a hose that sometimes has a grip area. However, this type of connection system is somewhat expensive to manufacture, and in any event is designed to be a non-permanent connection.

Accordingly, there exists a need in the art for an improved multi-component handle, particularly one that can be shipped, stored, and sold in multiple segments, and then easily and essentially permanently assembled by a consumer.

SUMMARY OF THE INVENTION

The invention provides a multi-segment handle in which the parts can be quickly snapped together to be essentially rigid along its length as if it was a monolithic structure. In one aspect the invention provides a handle assembly having at least two elongated sections, one such elongated section having a male end, and another such elongated section having a female end. If desired, both sections may have both types of ends.

The female end defines an internal cavity and a recess spaced from a terminal edge of that elongated section that is in communication with the cavity. The male end is sized to fit within the internal cavity and has a D-shaped spring tab that deflects inwardly during initial insertion of the male end into the internal cavity. The tab and recess are sized such that when the male end is in the female end, and the tab and recess are aligned, the tab snaps radially outwardly into the recess to lock the two elongated sections together.

In preferred forms, the recess extends from the cavity radially through an outer wall of the elongated section having the female end, the male end has a reduced outer diameter relative to the majority of the elongated section that has the male end, the male end is hollow, the male end includes a pair of slits extending in an axial direction to a terminal edge of the male end, and there are two such tabs on the male end, and two such recesses in the female end. Also, it is highly preferred that the female end have an axial groove extending from a terminal edge of the female end to the recess.

In other forms the D-shaped tab has a curved leading edge and a straight trailing edge, with the trailing edge projecting farther radially outward than the leading edge, the recess is also D-shaped, the tab tapers radially from an intermediate location to the leading edge of the tab, and the tab extends radially less than the thickness of the recess when the tab is in the recess.

In another aspect the invention provides a handle assembly that has an elongated grip section having an outer surface suitable to act as a handle and a lower connector end, at least one elongated pole section having an upper connector end and a lower connector end, and an elongated accessory attachment section having an upper connector and a lower yoke structure. The yoke has multiple arms for receiving and connecting to an accessory such as a mop head.

The upper and lower connector ends are configured such that the grip section can be snap locked to a pole section by axial relative movement between them causing a tab on one such section to move radially outward into a recess of another such section. The upper and lower connector ends are further configured such that a pole section can be snap locked to the accessory section by axial relative movement between them causing a tab on one such section to move radially outward into a recess of another such section.

Thus, the parts can be snapped together with a simple axial motion. As a result, and due to the flat sides of the D-tab and recess, the parts strongly resist relative rotation between them. Also, because of the ramped structure of the tab, the leading edge direction of the contoured part of the "D", the slits along the male part, and the axial groove along the female end cavity, the force needed to couple the segments is not great. However, because the D-shaped tab flat side contacts the flat side of the recess when the parts are interlocked, it is very hard to uncouple the segments.

The segments can be inexpensively molded, and if each of the intermediate pole segments can be made identical (with one female end and one male end) the middle pole segments can be connected in any order.

These and other advantages of the invention will be apparent from the detailed description and drawings.

DETAILED DESCRIPTION OF THE PREFERRED EMBODIMENTS

The invention provides a multi-segment handle that can be advantageously connected to mop heads or other devices such as paint rollers. The handle consists of several, preferably short (less then one foot in length) sections that can be shipped and sold in small packages that can be displayed on conventional horizontal shelving and easily toted home by the consumer.

Figure 1:
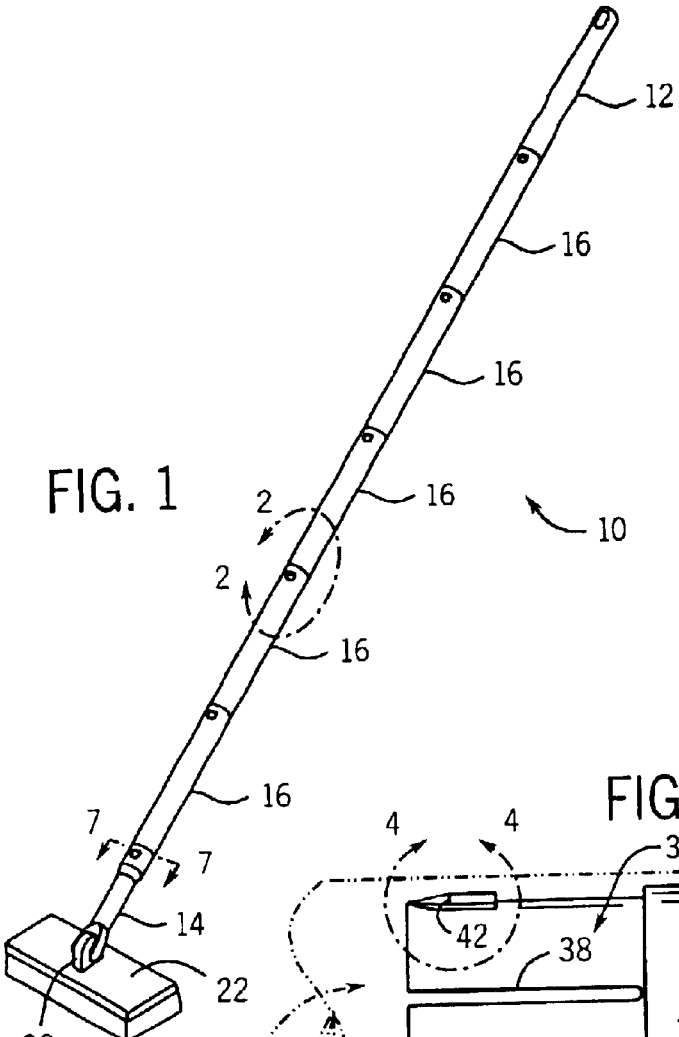
FIG. 1 is a perspective view of a floor mop provided with a multi-segment handle according to the present invention.
Figure 6:
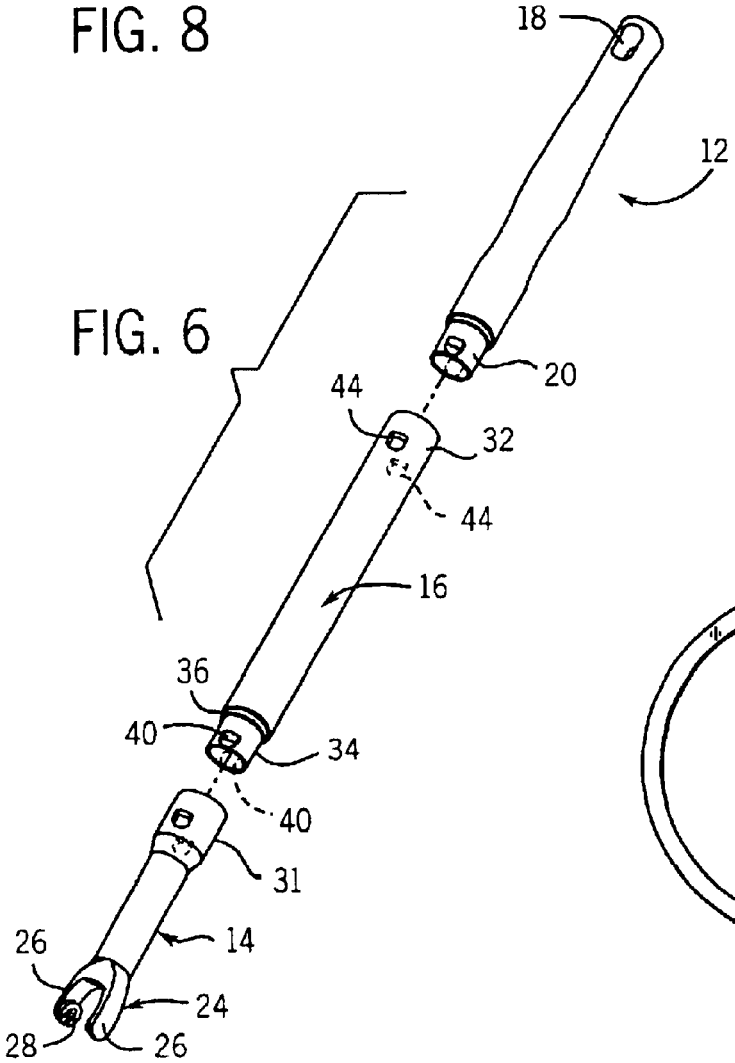
FIG. 6 is an exploded perspective view of the upper portion of the FIG. 1 device (without mop)

Referring to FIGS. 1 and 6, the handle has an upper grip section 12, a lower accessory section 14 and one or more pole sections 16. The components are preferably molded of a suitable rigid plastic.

The grip section 12 is preferably a molded solid of approximately 10–35 cm in length and preferably under 5 cm in diameter. It may also have an ergonomic contour for grasping by a hand (e.g. finger positions). The upper end of the grip section 12 has an opening 18 for hanging the handle 10 on a hook, nail or the like inserted either directly through the opening 18 or through a suitable strap (not shown) looped through the opening 18. The downward end of the grip section 12 may have either a female or a male connection end 20. It is only important that the portion of the pole section 16 to be adjacent to it has the opposite type of end.

At the opposite end of the handle 10 is the accessory section 14 to which can be attached various accessories 22 such as a bristled head (as in a broom or brush) and wet or dry mop heads. The accessory section 14 defines a yoke 24 at its lower end. The yoke 24 includes two arms 26 each preferably having a recess 28 (one shown) that can receive a hinge pin (not shown) extending through or from a side of a upstanding member 30 (see FIG. 1) of the accessory 22, as is conventional. Opposite the yoke 24, the accessory section 24 defines an enlarged connection end 31. Again, the end can be either a male end, or a female end, with it merely being important that the portion of a pole section to adjoin it must have the opposite type of end.

Between the grip 12 and accessory 14 sections are one or more interconnected pole sections 16. The number of pole sections 16 will depend on the desired length of the handle 10 when assembled and the desired size of the unassembled handle with consideration for intended size of the product package. In the preferred form shown in FIG. 1, the handle 10 includes five identical pole sections 16. Together, the overall handle is of a typical length for a mop handle.

Each pole section 16 is preferably hollow with an outer diameter of one size for most of its length, albeit with a narrower diameter female connection end 32. The female connection end has an internal cavity 33 (see FIG. 7) suitable to receive an opposite male 34 connection end of decreased diameter, albeit sized slightly larger than the diameter of the internal cavity 33.

Figure 2:
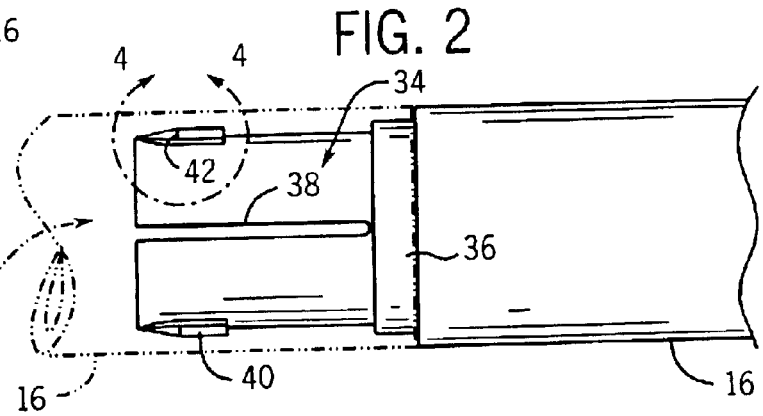
FIG. 2 is a partial side view focusing on region 2—2 of FIG. 1.
Figure 3:
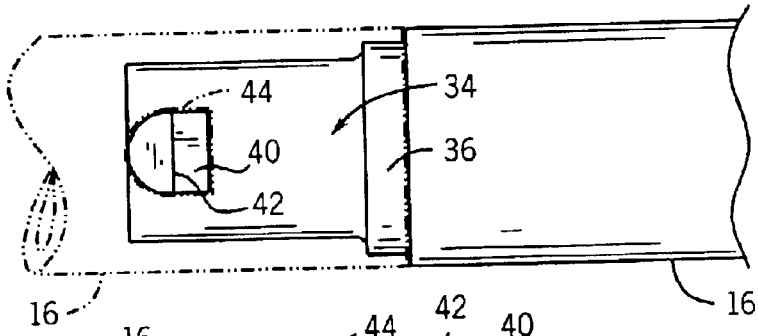
FIG. 3 is a partial top view focusing on region 2—2 of FIG. 1.
Figure 5:
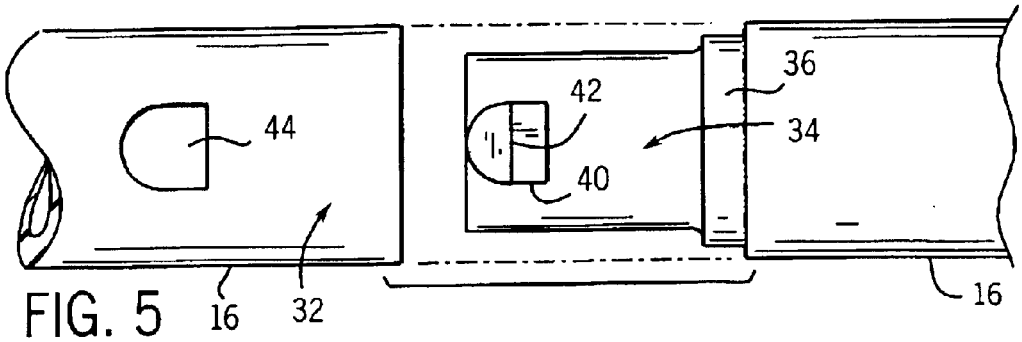
FIG. 5 is a partial exploded view, showing the position of the parts prior to axial movement to reach the FIG. 3 position.

Referring to FIGS. 2, 3 and 5, the male connection end 34 is preferably molded with a raised band 36 at the transition of outer diameters. The band 36 acts to increase the hoop strength of the male connection end 34 and thereby provide a more rigid and unified connection. The male connection end 34 includes two axial slits 38 spaced apart 180 degrees and extending from the band 36 through the terminal edge of the male connection end 34.

The slits 38 allow for inward deflection of the male connection end 34, which thus forms two spring tabs having projections 40 that extend radially outward from the male connection end 34. The projections 40 may be spaced apart 180 degrees and offset 90 degrees from the slits 38. Importantly, the projections 40 are essentially D-shaped in plan view with a curved side facing (preferably at) the terminal edge, a long flat side closest to the band 36, and somewhat flat sides transverse to the axis.

The projections 40 are quite shallow, even at their thickest. The projections 40 extend at a first thickness from the flat side to an intermediate point 42, from which they taper inwardly to the terminal edge.

Figure 7:
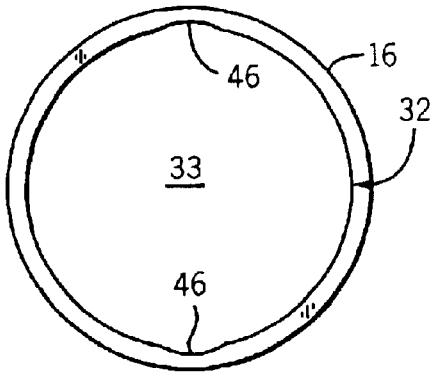
FIG. 7 is a top end view of the female end of the FIG. 6 middle section.

Referring to FIGS. 3 and 5, the female connection end 32 includes two D-shaped recesses 44 in communication with the internal cavity 33 spaced apart 180 degrees and oriented in axial alignment with the projections 40 of the male connection end 34 with the flat side nearest the terminal edge of the female connection end 32. As shown in FIG. 7, the female connection end 32 is formed with two shallow parallel grooves 46 extending axially from the terminal edge to the recesses 44.

The grip section 12 preferably has a male connection end 20 sized and configured identically to the male connection ends 34 of the pole sections 16, and the accessory section 14 preferably has a female connection end 31 identical to the female connection ends 32. Accordingly, the grip section 12 interlocks with an adjacent pole section 16 by mating end 20 of the grip section 12 with the female connection end 32.

End 31 of the accessory section 14 interlocks with the male connection end 34 of an adjacent pole section 14. Three additional pole sections 16 interlock together and to the pole sections 16 mated with the grip 12 and accessory 14 sections.

Figure 4:
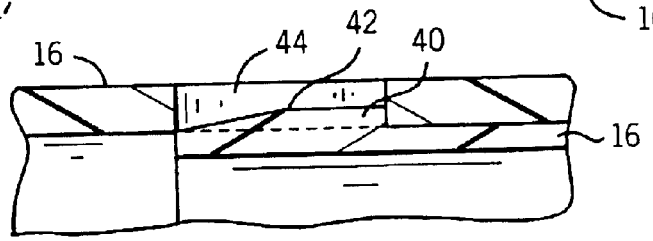
FIG. 4 is a partial cross-sectional view taken at region 4—4 of FIG. 2.

As shown in FIGS. 2–5, adjacent sections are mated by inserting a male end into a female end. The projections 40 are aligned with the axial grooves 46 and the adjacent sections are brought together. This causes the male end to deflect inwardly until the projections 40 reach the recesses 44. At this point, the built up spring force drives the projections 40 radially outward to "snap" in place. Twisting and separation of the sections is resisted at the joints because of the engagement of the flat sides of the respective D-shapes as shown in FIGS. 3 and 4.

The projections 40 are more shallow that the thickness of the recesses 44 such that the projections 40 are recessed within the recesses 44. This, and the rigidity of the plastic, makes it difficult to compress the male ends to separate the sections. Thus, the handle is not only rigidly connected at the joints but its sections are substantially permanently connected once joined.

This structure thus provides a handle in multiple smaller segments that can be shipped and sold in a compact package while at the same time providing a handle that is rigid and seems nearly monolithic when assembled. It should be noted, however, that the sections could be make more easily separable.

Figure 8:
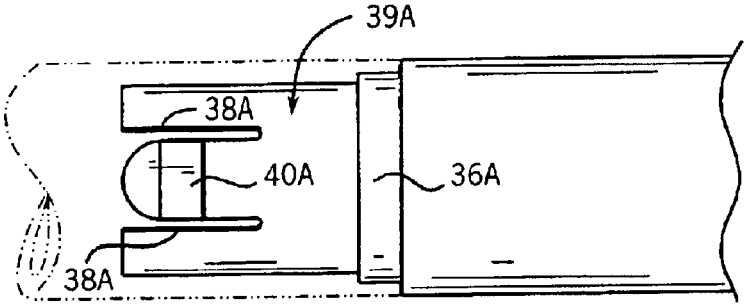
FIG. 8 is a top view similar to FIG. 3, albeit of an alternate male connection end.

An alternate version of a male connection end 34A for the grip 12 and pole 16 sections is shown in FIG. 8. Like the prior embodiment, here the male connection end 34A is of a decreased diameter from the body of the section and includes a raised band 36A and two D-shaped projections 40A spaced apart 180 degrees. However, the slits in this version are different. In particular, here there are two pair of slits 38A. Each pair extends axially approximately half the length of the end adjacent to opposite sides of the projections 40A, and thus defines cantilevered spring tabs. Using a rigid plastic, this embodiment can provide an essentially permanent connection, like above. However, this configuration localizes deflection to the smaller cantilevered spring tabs, which can decrease the deflection force required. Thus, this alternate embodiment of the male connection end could be employed to make the handle easier to disassemble, particularly when combined with a less rigid plastic and projections that extend beyond the recesses.

Preferred embodiments of the invention have been described in considerable detail. Modifications and variations to the preferred embodiments will be apparent to those skilled in the art, which will be within the spirit and scope of the invention. For example, although multiple short pole sections are preferred, the assembly could comprise only one pole section (of any length) without departing from the scope of the invention. Therefore, the invention should not be limited to the described embodiments. To ascertain the full scope of the invention, reference should be made to the following claims.

INDUSTRIAL APPLICABILITY

The invention provides an improved handle assembly.

We claim:

1. A handle assembly, comprising:

at least two elongated sections, one such elongated section having a male end, and another such elongated section having a female end;

the female end defining an internal cavity and a recess spaced from a terminal edge of that elongated section in communication with the cavity, the male end being sized to fit within the internal cavity and having a D-shaped spring tab that deflects inwardly during initial insertion of the male end into the internal cavity, the tab and recess being sized such that when the male end is in the female end with the tab and recess aligned, the tab snaps radially outwardly into the recess to lock the two elongated sections together and the tab in the recess inhibits relative rotational movement between the tab and recess;

wherein the tab has a straight trailing edge, a curved leading edge, and radially outward surfaces extending from the trailing edge to the leading edge, the radially outward surfaces having opposite straight side edges extending to an intermediate location from which the tab tapers radially inward to the curved leading edge such that the tab has a first specified side to side thickness from the trailing edge to the intermediate location.

2. The handle assembly of claim 1, wherein said recess extends from the cavity radially through the outer wall of the elongated section having the female end.

3. The handle assembly of claim 2, wherein said male end has a reduced outer diameter relative to the majority of the elongated section comprising the male end.

4. The handle assembly of claim 1, wherein said male end is hollow.

5. The handle assembly of claim 1, wherein said male end includes a pair of slits extending in an axial direction to a terminal edge of the male end.

6. The handle assembly of claim 1, wherein there are two such tabs on the male end, and two such recesses in the female end.

7. The handle assembly of claim 1, wherein said female end has an axial groove extending from a terminal edge thereof to the recess.

8. The handle assembly of claim 1, wherein said recess is D-shaped.

9. The handle assembly of claim 1, wherein said tab extends radially less than the thickness of said recess into which said tab snaps.

10. A handle assembly, comprising:

an elongated grip section having an outer surface suitable to act as a handle, said grip section having a lower grip connector end;

an elongated pole section having an upper pole connector end and a lower pole connector end; and an elongated accessory attachment section having an upper attachment connector end and a lower yoke structure having multiple arms for receiving an accessory; wherein said upper pole connector end and said lower grip connector end are configured such that the elongated pole section can be snap locked to the elongated grip section by axial relative movement between them, causing a tab on one of said sections to move radially outward into a recess in the other of said sections; and said lower pole connector end and said upper attachment connector end are configured such that the elongated pole section can be snap locked to the elongated accessory attachment section by axial relative movement between them, causing a tab on one of said sections to move radially outward into a recess in the other of such said sections and inhibit relative rotational movement between said tab and recess;

wherein each said tab is D-shaped having a straight trailing edge, a curved leading edge, and radially outward surfaces extending from the trailing edge to the leading edge, the radially outward surfaces having opposite straight side edges extending to an intermediate location from which the tab tapers radially inward to the curved leading edge such that the tab has a first specified side to side thickness from the trailing edge to the intermediate location.

* * * * *